US006477744B1

(12) United States Patent
Miles

(10) Patent No.: US 6,477,744 B1
(45) Date of Patent: Nov. 12, 2002

(54) VISOR CLIP

(76) Inventor: Gregory Henry Miles, 10625 Watson Rd., Williamsburg, MI (US) 49690

( * ) Notice: Subject to any disclaimer, the term of this patent is extended or adjusted under 35 U.S.C. 154(b) by 0 days.

(21) Appl. No.: 09/490,436

(22) Filed: Jan. 24, 2000

Related U.S. Application Data

(60) Provisional application No. 60/117,057, filed on Jan. 25, 1999.

(51) Int. Cl.[7] ..... A44B 21/00

(52) U.S. Cl. ..... 24/3.12; 24/3.1; 24/545

(58) Field of Search ..... 24/338, 339, 336, 24/11, 3 R, 81 CC, 10, 81 T, 81 TA, 81 PA, 81 VBA, 11 PP, 11 EE, 11 CT, 11 HC, 3 V, 81 PH, 11 R, 3.12, 499, 507, 520, 530, 533, 545, 547, 531, 561, 564, 570; D2/891; D8/395; 224/181, 269, 247, 547, 570; 248/316.7, 902; 268/74

(56) References Cited

U.S. PATENT DOCUMENTS

| | | | | | |
|---|---|---|---|---|---|
| 250,268 | A | * | 11/1881 | Loomis | 24/44 |
| 723,454 | A | * | 3/1903 | Foster | 24/44 |
| 803,464 | A | * | 10/1905 | Beck | 24/339 |
| 884,256 | A | * | 4/1908 | Addie | 248/229.26 |
| 2,594,211 | A | * | 4/1952 | Poupitch | 248/68.1 |
| 2,614,305 | A | * | 10/1952 | Yeardley | 24/3.8 |
| 3,521,332 | A | * | 7/1970 | Kramer | 403/188 |
| 3,983,602 | A | * | 10/1976 | Barry | 24/11 R |
| 5,184,375 | A | * | 2/1993 | Hoyt | 24/3.12 |
| 5,288,047 | A | * | 2/1994 | Pan | 248/229.26 |
| 5,787,556 | A | * | 8/1998 | Terzian | 24/545 |
| D401,005 | S | * | 11/1998 | Ludbrook et al. | D26/138 |
| 5,829,103 | A | * | 11/1998 | Allen | 24/11 R |
| 5,839,168 | A | * | 11/1998 | Elkins | 24/11 S |
| D430,699 | S | * | 9/2000 | Coleman, Jr. | D26/371 |
| 6,141,838 | A | * | 11/2000 | Cooper | 24/339 |
| D440,005 | S | * | 4/2001 | Blanton | 24/3.12 X |

* cited by examiner

*Primary Examiner*—Robert J. Sandy
*Assistant Examiner*—Ruth C. Rodriguez
(74) *Attorney, Agent, or Firm*—Reising, Ethington, Barnes, Kisselle, Learman & McCulloch, P.C.

(57) ABSTRACT

The visor clip for a vehicle visor is a one-piece member molded from a resilient material. The visor clip includes a primary clip, a secondary clip and a third clip. The primary clip and the secondary clip share the same bight portion. The third clip and the primary clip share one leg.

3 Claims, 1 Drawing Sheet

VISOR CLIP

This application claims the priority of U.S. provisional application Serial No. 60/117,057 filed Jan. 25, 1999.

TECHNICAL FIELD

The visor clip for holding a variety of items on a vehicle visor is molded from a resilient material and has a primary clip portion that holds the clip on a visor and a secondary clip that holds various items and cooperates with the primary clip portion.

BACKGROUND OF THE INVENTION

Clips have been used for many years to hold or grip a variety of items on a second item or structure. Some of these clips have been used to hold items such as eyeglasses on a vehicle visor. Others have been used to hold a pencil on a hat. An almost infinite number of examples of items connected together by clips over a period of centuries can be found.

Most of the clips used in recent years have been made from spring steel or employ a spring made from spring steel. Clips with a separate spring have two separate jaws that are moved toward each other to grip one or more items. One piece spring steel clips have two opposing gripping surfaces that are urged toward each other by resilience of the material. The two gripping surfaces may be in contact with each other when they are not holding an item or they can be spaced apart a predetermined distance. In either case they grip an item or items that spread the gripping surfaces when the item is moved between the gripping surfaces. Clips have been molded from plastic materials. These clips are molded from plastics that have sufficient resilience to grasp an item that tends to spread their opposed gripping surfaces apart.

Clips are known which have multiple pairs of gripping surfaces. Clips with multiple pairs of gripping surfaces have shared leg portions with adjacent pairs of gripping surfaces. When the leg portions are shared, placing a load between one pair of gripping surfaces generally has minimal influence on the second pair of gripping surfaces.

Vehicle visors are subjected to vibrations from the vehicle. These vibrations can vary from negligible to severe. Due to these vibrations, clips that attach to visors must provide substantial holding or clamping force. The required holding force increases as the total weight of items held by the clip increase.

SUMMARY OF THE INVENTION

The visor clip for holding items on a vehicle visor has a primary clip. The primary clip includes a primary bight, a first primary leg secured to the primary bight and a secondary primary leg secured to the primary bight. A first primary item engaging surface on the first primary leg faces toward a second primary item engaging surface on the second primary leg. A second clip includes a first secondary leg secured to the primary bight in a location spaced from the first primary leg and the second primary leg. The secondary clip also includes a second secondary leg secured to the primary bight in a location spaced from the first and second primary legs as well as from the first secondary leg. A first secondary item engaging surface on the first secondary leg faces toward a second secondary items engaging surface on the second secondary leg.

A third clip, which is formed on the visor clip, includes a bridge that is integral with a first outside surface of the first primary leg. A fifth leg has a fifth leg anchor end that is integral with the bridge and extends from the bridge generally parallel to the first outside surface of the first primary leg to form the third clip.

The visor clip includes a primary clip, a secondary clip and a third clip. The primary clip and the secondary clip have a common bight or bridge. The primary clip and the third clip have a common leg.

BRIEF DESCRIPTION OF THE DRAWINGS

The presently preferred embodiment of the invention is disclosed in the following description and in the accompanying drawings, wherein.

DESCRIPTION OF THE PREFERRED EMBODIMENT

Figure 1:
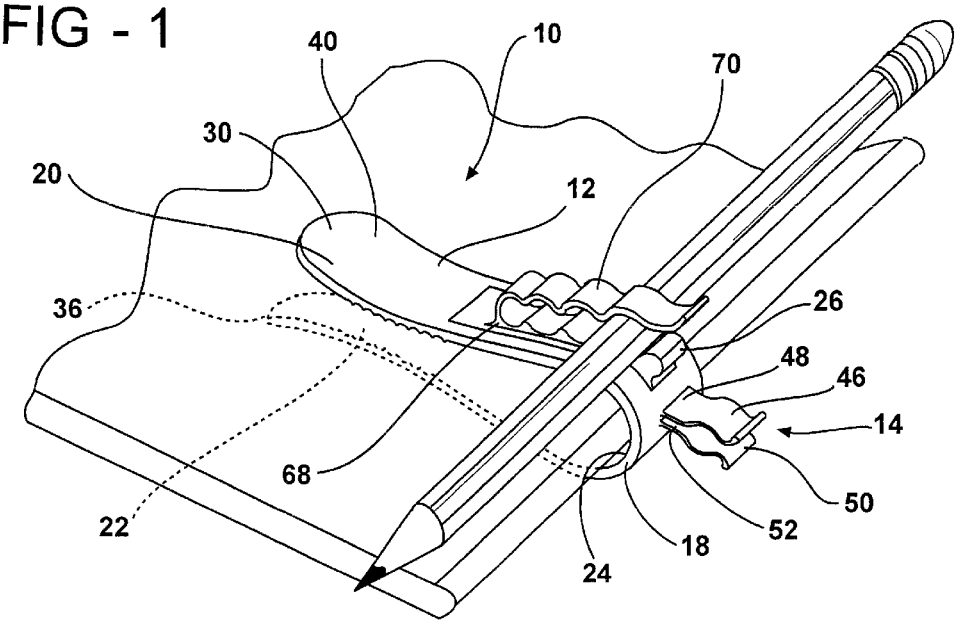
FIG. 1 is a perspective view of the visor clip attached to a visor and holding a pencil.
Figure 2:
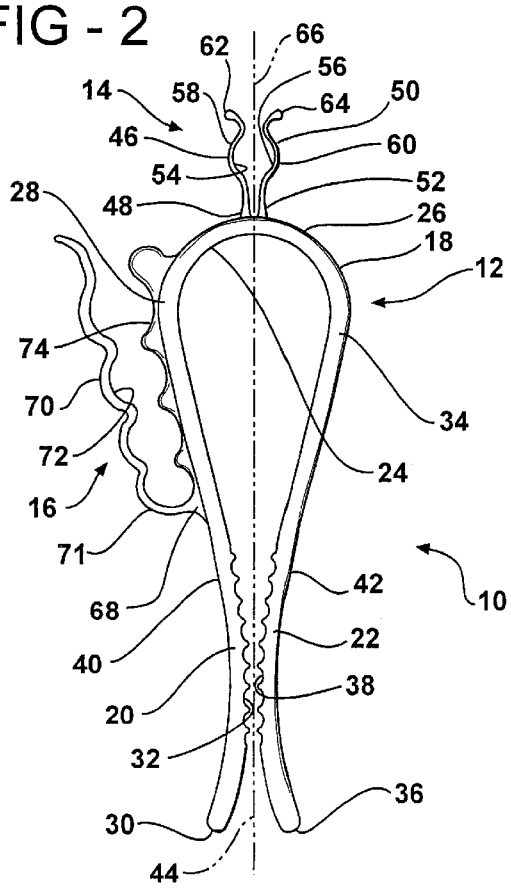
FIG. 2 is a front elevational view of the visor clip.
Figure 3:
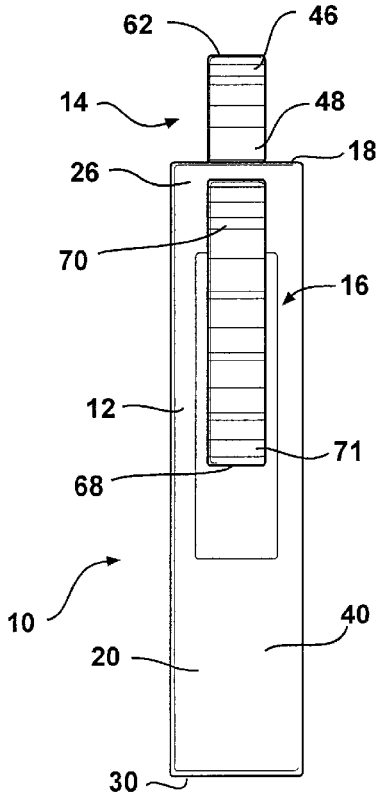
FIG. 3 is a side elevational view of the visor clip.

The visor clip 10 includes a primary clip 12, a secondary clip 14 and a third clip 16. The primary clip 10 includes a primary bight 18, a first primary leg 20 and a second primary leg 22. The primary bight 18 has a bight inside surface 24 and a primary bight outside surface 26. The first primary leg 20 has a first primary leg inner end 28 that is integral with the primary bight 18. The first primary leg 20 also has a first primary leg free end 30. A first primary leg item engaging is surface 32 is a first serrated surface that increases the co-efficient of friction to increase the holding power of the primary clip 12. The second primary leg 22 has a second primary leg inner end 34 that is integral with the primary bight 18. The second primary leg 22 also has a second primary leg free end 36. A second primary leg item engaging surface 38 is a second serrated surface with an increased co-efficient of friction that faces the first primary leg item engaging surface 32. The first and second primary legs 20 and 22 have a first primary leg outer surface 40 and a second primary leg outer surface 42. The primary clip 12 is symmetrical about a primary clip central axis 44 before the third clip 16 is added.

The secondary clip 14 has a first secondary leg 46 with a first secondary leg inner end 48 that is integral with the primary bight 18 and intersects the primary bight outside surface 26. A second secondary leg 50 has a second secondary leg inner end 52 that is integral with the primary bight 18 and intersects the primary bight outside surface 26. A first secondary leg item engaging surface 54 faces a second secondary leg item engaging surface 56 of the secondary clip 14. The first and second secondary legs 46 and so have first and second secondary leg outer surfaces 58 and 60 as well as free ends 62 and 64. The secondary clip 14 is symmetrical about a secondary clip center line 66. The secondary clip center line 66, as shown in the drawing, is coaxial with the primary clip center line 44.

The third clip 16 includes a bight or bridge 68 that is integral with the first primary leg 20 and also intersects the first primary leg outer surface 40. A fifth leg 70 has a fifth leg anchor end 71 that is integral with the bridge 68. The body of the fifth leg 70 extends from the bridge 68 generally parallel to the first primary leg 20. A fifth leg item contact surface 72 faces toward an item contact surface 74 formed by a portion of the first primary leg outer The visor clip 10 is preferably molded using a resilient plastic material. The primary clip 12 and the secondary clip

14 cooperate with each other to increase the clamping force of one of the two clips when the legs of the other clip are spread apart by an item that is to be held by the visor clip 10.

The disclosed embodiment is representative of a presently preferred form of the invention, but is intended to be illustrative rather than definitive thereof. The invention is defined in the claims. surface 40 to form the third clip 16.

What is claimed is:

1. A clip molded from a resilient material comprising:

a primary clip having a primary bight with a primary bight inside surface, a primary bight outside surface, and a primary bight width;

a first primary leg having a first primary leg inner end integral with said primary bight, a first primary leg item engaging surface, a first primary leg free end, a first primary leg outer surface, and a first primary leg width that is the same as the primary bight width;

a second primary leg having a second primary leg inner end integral with said primary bight, a second primary leg item engaging surface that faces toward the first primary leg item engaging surface, a second primary leg free end, a second primary leg outer surface, and a second primary leg width that is the same as the primary bight width;

a secondary clip with a first secondary leg having a first second leg inner end integral with said primary bight and intersecting the primary bight outside surface, a first secondary leg item engaging surface, a first secondary leg. free end, a first secondary leg outer surface, and a first secondary leg width that is less than the primary bight width;

a second secondary leg having a second secondary leg inner end integral with said primary bight and intersecting the primary bight outside surface, a second secondary leg item engaging surface facing the first secondary leg item engaging surface, a second secondary leg free end, a second secondary leg outer surface, and a second secondary leg width that is the same as the first secondary leg width;

a bridge integral with the first primary leg and intersecting the first primary leg outer surface, a fifth leg having a fifth leg anchor end integral with the bridge, a fifth leg width that is less than the primary bight width and wherein the fifth leg extends from the bridge generally parallel to the first primary leg outer surface to form a third clip;

wherein said primary clip is symmetrical about a primary clip center line and the secondary clip is symmetrical about the primary clip center line; and the width of the bight, the bridge, the fifth leg and each leg of the primary clip and the secondary clip extending in a common direction.

2. A clip as set forth in claim 1 wherein the first primary item engaging surface is a first serrated surface and the second primary item engaging surface is a second serrated surface.

3. A clip as set forth in claim 2 wherein the first secondary leg item engaging surface is a first secondary leg serrated surface and the second secondary leg item engaging surface is a second secondary leg serrated surface.

* * * * *